United States Patent [19]

Boyce

[11] 4,442,059

[45] Apr. 10, 1984

[54] RIGID BUILDING FRAME WITH INFLATABLE MEMBER

[76] Inventor: Norman A. Boyce, 38 Ratby La., Markfield, Leicester, England

[21] Appl. No.: 397,931

[22] Filed: Jul. 13, 1982

[30] Foreign Application Priority Data

Jul. 14, 1981 [GB] United Kingdom ..... 8121683
Jan. 20, 1982 [GB] United Kingdom ..... 8201584

[51] Int. Cl.[3] ..... B28B 9/04

[52] U.S. Cl. ..... 264/228; 52/2; 52/81; 249/36; 249/65; 264/32; 264/35; 264/45.2; 264/314; 425/DIG. 112

[58] Field of Search ..... 264/32, 314, 308, 309, 264/228, 229, 35, 45.2; 425/DIG. 112; 249/65, 36; 52/2, 80, 81

[56] References Cited

U.S. PATENT DOCUMENTS 3,056,183 10/1962 Pigeot ..... 264/314 X
3,057,368 10/1962 Seaman ..... 264/32 X
3,225,413 12/1965 Bird et al. ..... 264/32 X
3,996,320 12/1976 Bini ..... 264/314
4,077,177 3/1978 Boothroyd et al. ..... 264/32 X

*Primary Examiner*—Donald E. Czaja
*Assistant Examiner*—James C. Housel
*Attorney, Agent, or Firm*—David W. Pettis, Jr.

[57] ABSTRACT

The invention describes a method of constructing a building involving the assembly of a rigid skeletal framework of struts defining the contours of the desired building which is for example domed, or part-barrel shaped. A membrane or envelope of plastics material is inflated within the framework to lift the struts from a state of compression under their own weight into a state of tension. The membrane is then coated on at least one side with settable material such as concrete or other glass fibre reinforced material and the membrane deflated when the material has set. In an example of the invention, support zones at the junctions of the struts support the set material.

10 Claims, 13 Drawing Figures

RIGID BUILDING FRAME WITH INFLATABLE MEMBER

BACKGROUND OF THE INVENTION

The invention is concerned with improvements in or relating to building construction. In particular the invention relates to a method of construction in which a rigid framework is formed, the interstices of which are subsequently infilled to form structures, panels, walls, and the like, which are included in the context of this specification in the general term being "buildings".

It has become increasingly popular to construct buildings particularly of large ground plan area such as are suitable, for example, for halls and exhibition sites from a rigid skeletal structure of steel struts or tubular members interconnected by means of connecting clamps. The structure is then clad with steel sheeting or screeded for laying concrete thereupon to form a shell. Such a construction is, of course, under compression from its own weight and is only as strong as its connecting clamps.

A considerable amount of design work has therefore been necessary to produce clamps of a strength commensurate with the strength of the steel struts or tubes. This design work has been complicated by the requirements for many of these buildings to form part - cylindrical, domed or barrel-shaped spans of various plan areas. These shapes mean that the angles at which the struts meet are variable not only from building to building but also at different locations in the same structure. Where it is desirable to avoid the necessity for the manufacture of these clamps in made-to-measure batches, attempts have been made to produce adjustable clamps. In order to achieve the strength required, these adjustable clamps are relatively expensive to produce.

Moreover, such clamps are normally exposed to atmosphere and therefore subject to corrosion, unless steps are taken to protect them, which adds to cost.

It is an object of the present invention to minimize reliance upon the strength of the interconnecting clamps in a building of the above description, so reducing the above disadvantages relating to this type of building construction, and providing a method of construction which is strong and relatively inexpensive.

It is also an object of the invention to obviate the need for the provision of separate panels for incorporation into the structure and consequent requirement for additional attachment points to the framework. Sealing problems are also avoided.

SUMMARY OF THE INVENTION

The invention therefore provides a method of building construction comprising the steps of (a) erecting a rigid skeletal framework of struts or tubular members to define the contours of the desired building, and securing the struts or members together at appropriate intersections thereof, (b) providing within said framework an air-impervious membrane so as to provide an airtight envelope, (c) inflating said envelope within the framework, (d) coating at least one surface of the inflated membrane with settable material and (e) returning the air pressure within the envelope to normal.

Advantageously, the degree of inflation of the envelope in step (c) is great enough to take the framework from an as-assembled state of component compression between the struts or members to a state in which there is tension between the components, and wherein the external surface of the membrane is coated in step (d) with settable material, so that when the air pressure is returned to normal within the envelope, the struts or members return to a non-tensioned state and detach from the newly set material, said material being arranged to remain in contact with support zones situated at the intersections of the struts or members.

It will be appreciated therefore that the set material, which forms a hardened shell, is supported upon these support zones and therefore longitudinally through the struts or members which are subjected to compressive strain. Thus the struts or member may support a greater weight of shell that in cases where the shell is in direct contact with the struts, exerting a lateral pressure thereupon which tends to bend the struts or members, causing probable failure.

Advantageously, the support zone comprises support plates secured to joining devices to which are securable end portions of the struts or members.

Conveniently, the settable material is a suitable glass-fibre resin or concrete and the finished construction is in a prestressed condition.

If desired, the settable material is applied to one surface only of the membrane, that surface which confronts the framework. The settable material is arranged completely to cover the framework and the membrane, which membrane may if desired be removed when the material is set. Where this exposes the inner side of the clamps, localized application of settable material, if desired, be made to the clamps to embed them completely and so protect and strengthen them.

Alternatively, the struts and clamps or other joining means may be pre-clad with a sleeving of, for example, expanded polyurethane. This prevents actual contact between the concrete and the metal of the framework and minimizes any risk of damage through differences in co-efficients of expansion. The clamps may also conveniently be encased in polyurethane foam in order to isolate them from the framework.

In an example of construction according to the invention a building is constructed by erecting a framework of steel tubing clamped together at appropriate intersecting portions of the tubing by clamping means comprising tubular sockets welded or otherwise assembled together at appropriate angles. Polyethylene or polyvinyl chloride (p.v.c.) membrane is introduced within the area defined by the framework and the margins of the membrane secured in an air-tight manner to the flooring of the building. Compressed air is then introduced into the envelope defined by the membrane and the flooring to a pressure sufficient to take the weight of the steel tubing to an extent where the construction is no longer under compression but is actually under slight tension. A glass-fibre-reinforced resin or cement is then sprayed on the outside surface of the membrane so as to coat it and also to cover the framework of steel tubing and connecting clamps. When this coating is at the desired thickness, the resin is allowed to set, and then the air pressure released. If desired, the membrane may then be carefully removed for re-use. The inner surfaces of the construction may then be sprayed with the resin, at least in the regions of the connecting clamps to cover them completely. It will be understood that the membrane "balloons" out between the lengths of steel tubing so that the finished construction has a 3-dimensional appearance which may be considered aesthetically pleasing in comparison with a flat or plain curved surface, and has greater structural strength.

In an alternative example of the invention, a wall construction may be formed by first erecting a framework of steel tubing defining the contours of a wall of the desired thickness. Tubular envelopes of polyethylene are then introduced side by side into the thickness of the wall so as to contact immediately neighbouring tubes when inflated. Resin of a suitable type is then sprayed onto each outer surface of the wall when the tubes are inflated. When the resin has set, the polyethylene-lined cavities in the wall may be filled with foamed insulating material to produce a strong, heat-insulating, fire-resisting wall construction which has been erected in a short time at a reduced cost compared with conventional walls.

A convenient form of framework may comprise a number of struts which may be screwed together by means of a joining device having a plurality of arms each provided with a screw-threaded end portion, the number of arms depending on the design of the framework and generally being between three and six.

It will be apparent that the arms radiating from a central hub portion are not usually in the same plane, the angles of the arms with respect to the central hub portion being calculated with reference to the shape and size of the building.

Particularly in the assembly of a domed structure, it may well be found that a strut is required to be inserted between two joining devices, the positions of which are already fixed. It is necessary then to introduce into the construction of the strut a facility for a temporary reduction in the length thereof. The struts may therefore be formed in two portions, one slidably received within the other to a limited extent in a telescopic manner.

It will be found convenient to incorporate into the framework of a building construction according to the invention an adjustable coupling device as described and claimed in British Patent No. 2018932, and also to introduce into this type of coupling device the facility to reduce its overall length in order to assist assembly.

There will now be described two examples of a method of building construction according to the invention. It will be understood that the description, which is to be read with reference to the accompanying drawings, is given by way of example only and not by way of limitation.

DETAILED DESCRIPTION

Figure 1:
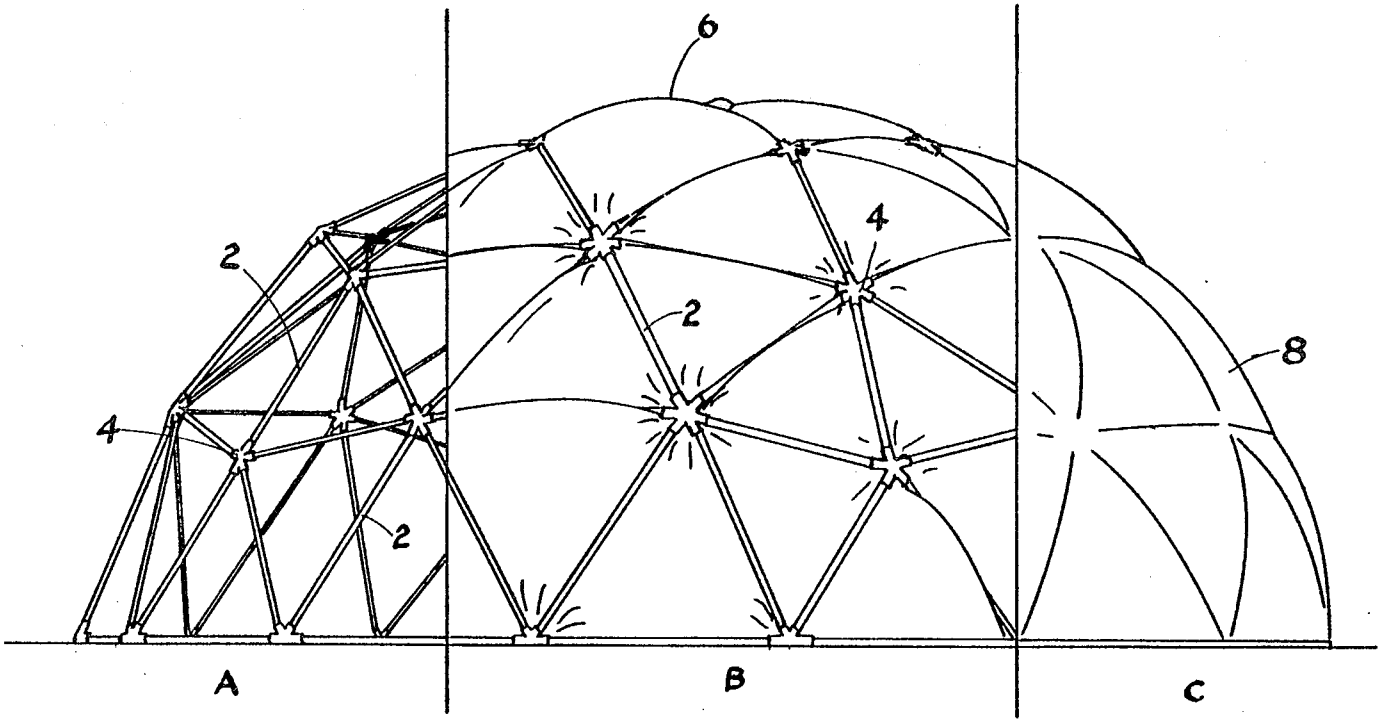
FIG. 1 shows a first domed building constructed according to the method of the invention, in three steps of construction.

The building shown in FIG. 1 is a geodesic dome, the advantage of which is that in such a structure, the components are already in a partial state of tension.

Portion A of FIG. 1 shows a framework of steel tubing 2 interconnected by clamp devices 4 which provide four, five or six connection points as required. The clamp device, may be any convenient type but preferably, as in this example, are selected to be capable of accepting end portions of the tubing at appropriate angles. It will be appreciated that the angles between the tubing varies both with the plan area of building and the size of the vault, and it is convenient to supply to a suitably programmed computer device details of the size of the required building and its components so that the clamps may be manufactured with the correct angles built-in, as explained below with reference to FIG. 2, or may be adjustable so that the arms thereof may be pre-adjusted to the correct angle prior to erection.

Portion B of the drawing shows the framework infilled with an inflated membrane 6, which serves also to increase the tension in the components.

Portion C shows a coating layer of concrete 8 applied to cover the framework and the membrane.

Figure 2:
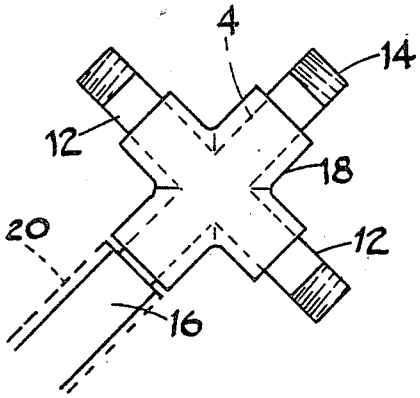
FIGS. 2 and 3 are plan and side views respectively of a joining device suitable for use in the framework of the first building.
Figure 3:
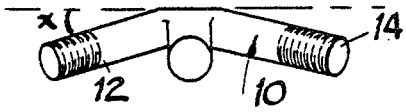

FIGS. 2 and 3 show a clamp or joining device 4, which, as shown, have four arms 12, each provided with a screw-threaded end portion 14 to which is securable a strut 16. Where the building is to be clad in concrete and it is desired to minimize the damaging effect of uneven expansion and shrinkage of the concrete and the metal struts, it will be found advantageous to encase the device 4 is sleeving 18 of expanded polyurethane and also to provide sleeving 20 on the struts 16.

The arms 12 of the joining device 4 will not normally lie in the same plane when they are intended for use in a domed building. As mentioned above, the exact value of the angle x shown in FIG. 3 will require calculation to produce a dome of the correct radius and plan area.

Figure 4:
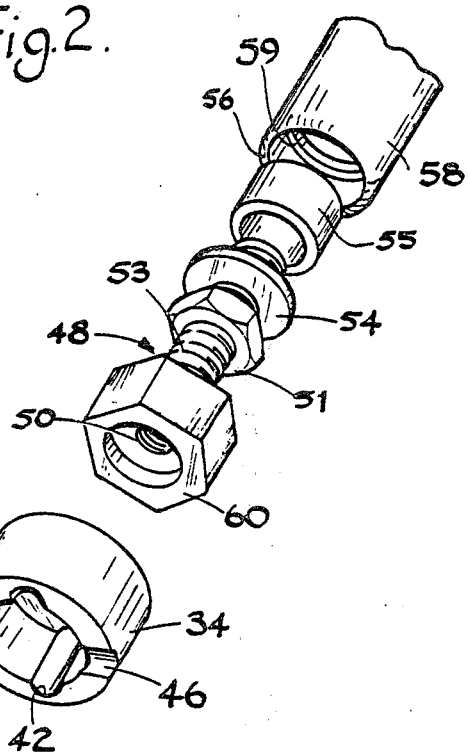
FIG. 4 is an exploded view of an adjustable coupling device.

FIG. 4 shows a coupling device which may be used as part of the framework of a domed building, for example, to anchor the struts thereof to other struts or to a substrate.

Figure 6:
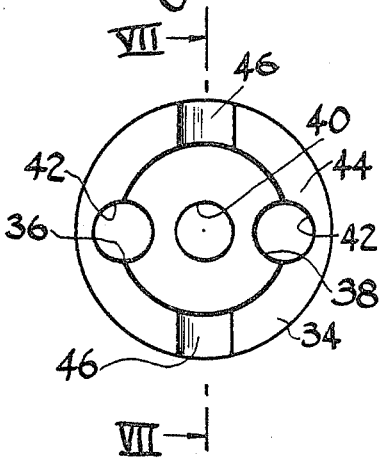
FIG. 6 is an end view of a sleeve member of the coupling device.
Figure 7:
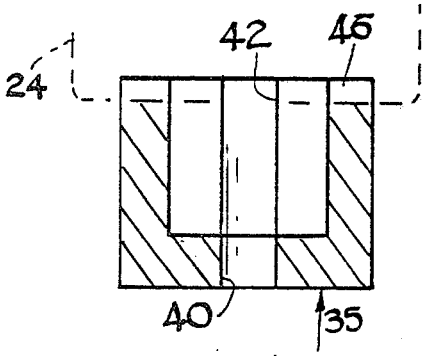
FIG. 7 is a section on line VII—VII of FIG. 6.

The coupling device comprises U-shaped link 22 which engages a carrier link 24 to which similar couplings may be attached. Leg portions of the link 22 are provided with recesses 26 arranged to confront each other and to receive a cross member 28 in the form of the circular head of a bolt 30 which head is provided with two flats 32, one to engage each of the recesses 26. Surrounding the leg portions of the link 22 and the cross member 30 is a sleeve member 34, which is provided with an end wall 35 having three apertures 36, 38, 40 arranged to receive the two leg portions and a threaded portion of the bolt 30, respectively. Grooves 42 in the inner surface of the sleeve member provide means to restrain the link member from rotary movement. An end surface 44 of the sleeve is provided with contoured portions 46 which co-operate with the carrier link 24 (See FIG. 6).

An adapter member 48 comprises a bolt having a threaded bore 50 formed in the head thereof into which the threaded portion of the bolt 30 is received. A lock nut 51 is received on the externally threaded stem portion 53 of the member 48 together with a washer 54. The stem portion 53 is received in an internally threaded member 55, which is received within a tubular strut 58, or a tubular end portion provided on a solid strut, fitted over the member 55. Lip portions 56 of the strut 58 are inturned so as to retain the member 55 within the strut 58. It will be observed that the strut is slidable on the stem portion 53 so as to allow for temporary reduction in the overall length of the device.

In order to facilitate the locking of the device in an extended condition, the lock nut 51 may be turned until the inturned edge portions 56 of the strut 58 are trapped between the washer 54 and the member 55 into which the stem portion 53 is fulled screwed. The presence of a further washer 59 insures a completely sealed fit.

Figure 5:
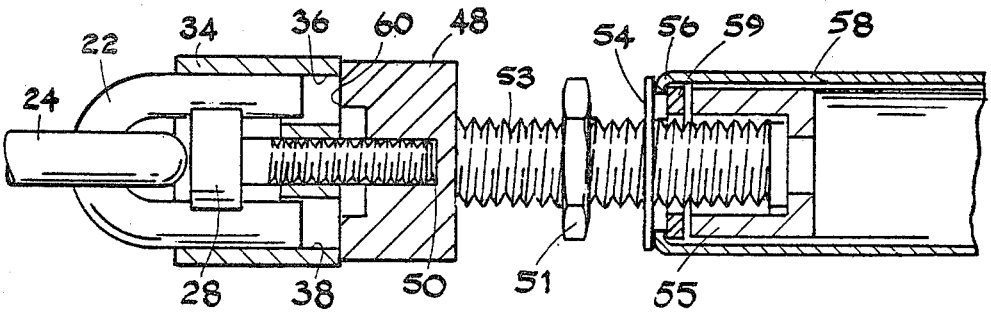
FIG. 5 is a view partly in section of the assembled coupling device.

It will be appreciated that as the adapter member is rotated to increase the penetration of the bolt into the bore 50, so that the sleeve member is forced in a direction towards the left of FIG. 5 by contact of a leading surface 60 of the adapter means against the end wall 35 of the sleeve member. The contoured portions thus engage and firmly clamp the carrier link 21, thus preventing relative movement between the carrier 24 and the link 22.

Figure 8:
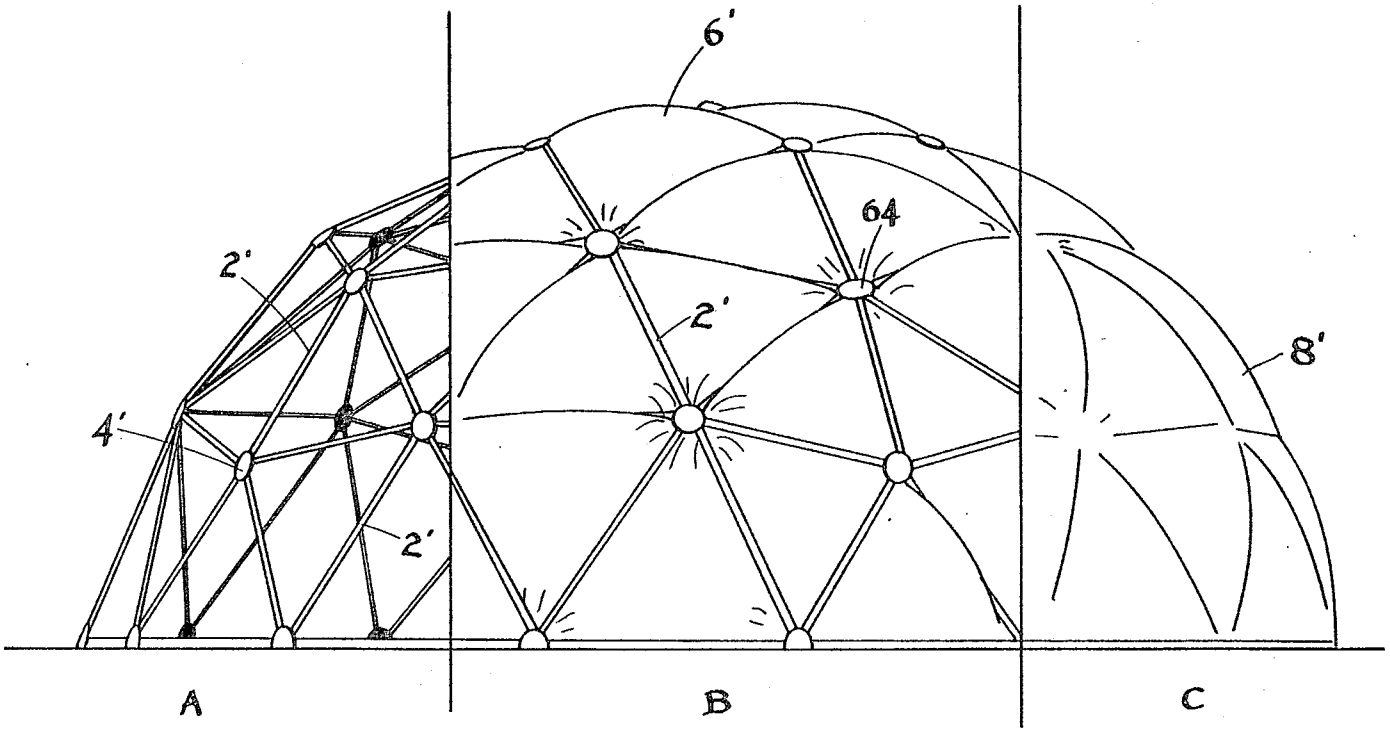
FIG. 8 shows a second domed building constructed according to the method of the invention, in three stages of construction.

FIG. 8 shows a second geodesic dome similar in many respects to that of FIG. 1.

Figure 9:
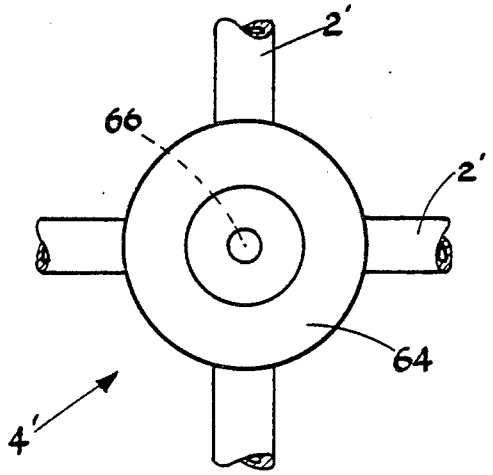
FIG. 9 is a plan view of a joining device incorporating a support zone.
Figure 10:
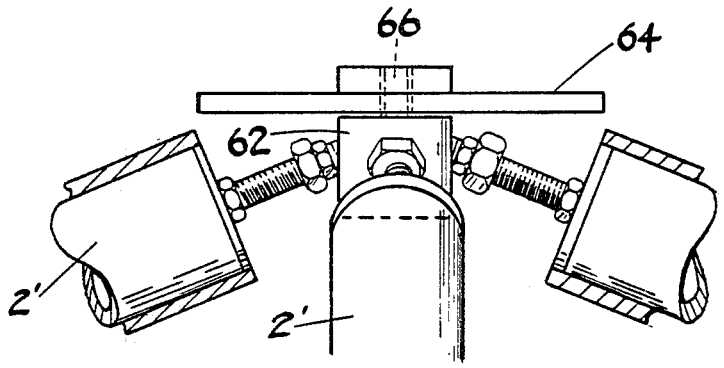
FIG. 10 is a side view (partly in section) of the joining device of FIG. 9.

Portion A of FIG. 8 shows a framework of struts of steel tubing 2' interconnected by clamps or joining devices 4' providing four, five or six connection points, an example of which is shown in detail in FIGS. 9 and 10.

Portion B of FIG. 8 shows the framework infilled with an inflated membrane 6' which serves to put the struts 2' into a state of tension to an extent where the struts tend to bow slightly outwardly.

Portion C shows a coating layer of concrete 8' applied to cover the framework and the membrane.

FIGS. 9 and 10 show details of one of the joining devices 4'. The device comprises a cylindrical body portion 62 to which are secured by screw thread means, for example, four struts 2, arranged at suitable angles to form the domed shape of the building. A support plate 64 is provided which is attached to a threaded spigot 66 projecting from the body portion 62.

Figure 11:
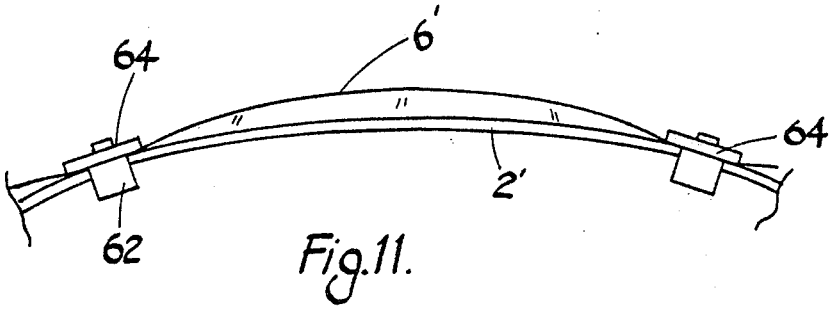
FIGS. 11 to 13 are diagrammatic views (not to scale) of three stages of operation of the method of the present invention.
Figure 12:
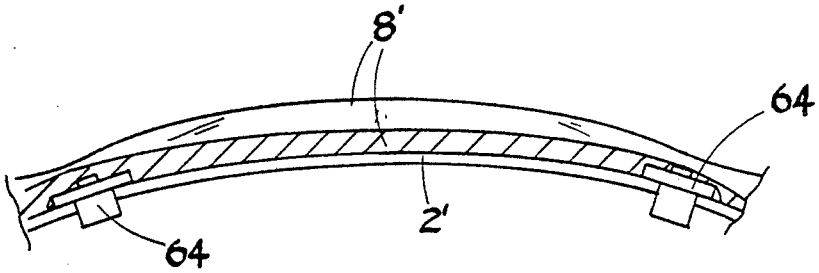
Figure 13:
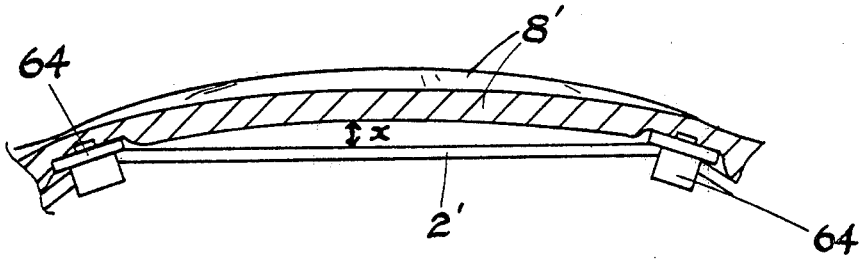

Two adjacent support plates 64 are shown in FIGS. 11–13 linked by a strut 2'. FIG. 11 shows the strut 2' bowed slightly upwardly and outwardly under the influence of the inflation of the membrane 6'.

A layer of concrete 8' is then applied to coat the membrane 6' and the plates 64. During this stage the weight of the concrete is partly borne by the bowed strut 2', but when the concrete has set and the envelope is no longer inflated, see FIG. 13, the strut 2' will restraighten and move away from the membrane-covered concrete 8' by a distance x. This will leave the weight of concrete supported upon the plates 64 and not directly upon the struts. Thus the plates 64 provide the support zones situated at the intersections of the struts. In this manner, the weight of the concrete shell will cause the struts to be under lengthwise compression. The framework is therefore rendered more rigid and therefore effectively stronger than if the weight of the shell were to be received in a lateral manner on side surfaces of the struts.

It will be understood that the struts described may be solid or hollow. In the case of hollow struts, these may take the form of pipes linked through joining devices provided with interconnecting bores for the passage of liquids. For example, in a construction capable of utilizing solar heat, water may be circulated through such a framework of pipes to connect solar heating panels to a heated water storage container, for example a hot water cylinder or a swimming pool.

In a further example of the invention the membrane is laid over the framework and settable material sprayed onto the underside of the membrane. There will, however, be a considerable gap exposed between the membrane and each strut where the strut surface curves away from the membrane and to avoid the use of excessive material in filling such gaps they are filled prior to spraying of the material with lengths of packing material such as urethane foam. The lengths have suitable cross-sections, typically wedge-shaped. Alternatively, the gaps can be closed off by tape or the like to leave air pockets on each side of the struts.

1. A method of building construction comprising the steps of (a) erecting a rigid skeletal framework of struts or tubular members to define the contours of the desired building, and securing the struts or members together at appropriate intersections thereof to form support zones, (b) providing within said framework an air-impervious membrane so as to provide an airtight envelope, (c) inflating said envelope within said framework at sufficient pressure to take said framework from an as-assembled state of component compression between the struts or members to a state in which there is tension between the components, (d) coating the external surface of said inflated membrane with settable material, and (e) returning the air pressure within the envelope to normal thereby permitting the struts or members to return to a non-tensioned state and detach from the newly set material, said material being arranged to remain in contact with support zones situated at the intersection of the struts or members.

2. A method as claimed in claim 1, wherein each support zone comprises a support plate secured to joining devices to which are securable end portion of the struts or members.

3. A method as claimed in claim 2, wherein the settable material is applied only to that surface of the membrane which confronts the framework.

4. A method as claimed in claim 3 wherein the membrane is removed when the settable material has set.

5. A method as claimed in claim 4 wherein the joining devices exposed by the removal of the membrane are then coated by localized application of amounts of settable material thereto.

6. A method as claimed in claim 4 wherein the struts or members and the joining devices are pre-clad with a sleeving of isolating material.

7. A method as claimed in claim 1 wherein the framework is arranged in two shell formations one within the other to define the contours of a wall of a desired thickness, the membrane being formed into a plurality of tubular envelopes introduced into the thickness of the wall between the shells and inflated so as to contact neighbouring envelopes.

8. A method as claimed in claim 7 wherein the inflated envelopes are filled with foamed insulating material.

9. A method as claimed in claim 1 or 7 wherein the struts or members are hollow pipes linked through joining devices provided with interconnecting bores for the passage of liquids.

10. A method as claimed in claim 1 or 7 wherein at least a proportion of the struts and members employed are adjustable lengthwise in a telescopic manner to facilitate assembly.

* * * * *